106-15.05 SR
9/2/80 XR 4,220,688

United States Patent [19]
Mitchell et al.
[11] 4,220,688
[45] Sep. 2, 1980

[54] PROTECTING WOOD FROM WOOD DEGRADING ORGANISMS

[76] Inventors: Ralph Mitchell, 27 Mason St., Lexington, Mass. 02173; Thomas D. Sleeter, 840 Arcadia Ave., Arcadia, Calif. 91006

[21] Appl. No.: 938,402

[22] Filed: Aug. 31, 1978

[51] Int. Cl.[2] ..... B27K 3/52

[52] U.S. Cl. ..... 428/541; 106/15.05; 427/331; 427/369; 427/440; 428/537; 428/907

[58] Field of Search ..... 427/331, 369, 419 R, 427/351, 431, 440, 325; 428/537, 540, 541, 907; 106/15 AF, 15 R, 15.05; 21/7; 422/6

[56] References Cited

U.S. PATENT DOCUMENTS

| | | | |
|---|---|---|---|
| Re. 4,158 | 1/1867 | Samuels et al. | 427/419 R |
| Re. 4,550 | 7/1871 | Siebel | 427/419 R |
| 339,463 | 4/1886 | Piron | 428/907 |
| 2,054,400 | 9/1936 | White et al. | 427/351 |
| 2,062,877 | 12/1937 | Goodale | 428/907 |
| 2,652,347 | 9/1953 | Hudson | 427/351 |
| 2,690,400 | 9/1954 | Hubbell | 106/15 AF |
| 2,983,630 | 5/1961 | Anderson | 428/541 |
| 3,493,324 | 2/1970 | Calvarin et al. | 106/15 AF |
| 3,671,299 | 6/1972 | Barnett | 428/907 |
| 4,035,546 | 7/1977 | Ruppert | 428/907 |

FOREIGN PATENT DOCUMENTS

| | | | |
|---|---|---|---|
| 508848 | 1/1955 | Canada | 106/15.05 |
| 46-41236 | 6/1971 | Japan | 428/541 |
| 3790 | of 1882 | United Kingdom | 106/15.05 |

OTHER PUBLICATIONS

Chemical Abstracts, vol. 20, 1954, 342g.
Chemical Abstracts, vol. 75, 1971, 22738x.
Chemical Abstracts, vol. 77, 1972, 63582b.

*Primary Examiner*—Ronald H. Smith
*Assistant Examiner*—Sadie L. Childs
*Attorney, Agent, or Firm*—Joseph S. Iandiorio

[57] ABSTRACT

Wood is impregnated with a solution of tannic acid followed by impregnation with a solution of a metal in the form of a salt. The metal selected is one that will complex with both the impregnated tannic acid and the wood.

16 Claims, No Drawings

PROTECTING WOOD FROM WOOD DEGRADING ORGANISMS

The government has rights in this invention pursuant to Contract No. N0014-76-C-0042 awarded by the Department of the Navy, Office of Naval Research.

FIELD OF THE INVENTION

The invention relates to protecting wood from wood degrading organisms including termites, wood attacking fungi and marine borers, such as teredos and Limnoria, and represents an improvement of the invention disclosed in U.S. patent application Ser. No. 619,565, now abandoned.

BACKGROUND OF THE INVENTION

In U.S. patent application Ser. No. 619,565, filed Oct. 6, 1975, now abandoned, Ilan Chet, Ruth Turner, and Ralph Mitchell, one of the joint inventors herein, described their invention of a process for protecting wood from marine borers by impregnating the wood with tannic acid. That invention provides an effective, inexpensive, nontoxic, and noncarcinogenic process as an alternative to the well-known use of creosote for that purpose. However, although that process gives relatively long-lasting protection for wood so impregnated, it would plainly be desirable to make such protection last longer still. It would also be desirable to reduce the amount of tannic acid needed for effective protection.

It is known in the field of organic chemistry that tannic acid forms a chemical complex with iron. See *Oxidation in Organic Chemistry,* ed. by Trabanoosky, 1973, Chapter 11, "Mechanisms of Phenolic Oxidative Coupling Reactions" by McDonald et al., pp. 97–134, particularly p. 103. It is also known in fields relating to work with tissues (e.g., histochemistry and zoology) that in staining tissue with tannic acid to darken it for visual contrast one can add iron or manganese to make the tissue retain the tannic acid longer.

SUMMARY OF THE INVENTION

We have discovered that the resistance of wood impregnated with tannic acid according to the aforesaid joint invention of Chet et al. can be prolonged and that the amount of tannic acid required for the same degree of protection against wood bores, termites, fungi and other sources of biodegradation can be reduced by following tannic acid impregnation with impregnation of the wood with a solution of a metal in the form of a salt, the metal being one that will complex with the tannic acid and the wood. This added step is easy and quick to accomplish, requires only inexpensive materials and conventional equipment, and yet gives a marked increase in the duration of borer resistance for wood so treated and makes possible use of substantially reduced amounts of tannic acid to achieve the result. Further, our invention permits use of cheaper wood, normally very sensitive to marine borers, in marine applications such as in docks, piers, and jetties.

In particular aspects the metallic salt solution is ferric chloride, and it is impregnated under the following conditions: salt concentration is one percent weight per volume of solvent; impregnation is under pressure of 40 psi; and impregnation time is one hour. Ferric chloride is very inexpensive, is nontoxic, and is effective in low concentrations.

DESCRIPTION OF THE PREFERRED EMBODIMENT

A supply of wood to be impregnated is predried, and conventional apparatus for commercial creosote impregnation is utilized. Instead of creosote, a 20 percent weight per volume solution of commercial grade tannic acid in ethanol is used. As used throughout this application, the term "percent weight per volume" means the ratio of the weight of solute in grams to the volume of solvent in milliliters multiplied by one hundred. The solution is impregnated into the wood under a pressure of 200 psi for twelve hours in the apparatus. Unabsorbed tannic acid is then removed from the apparatus, and a one percent weight per volume agueous solution of ferric chloride is introduced into the apparatus and impregnated into the wood under a pressure of 40 psi for one hour. The wood will turn black, indicating that the impregnated ferric chloride has formed a complex with the impregnated tannic acid and the wood. The wood is then removed from the apparatus.

TEST EXAMPLE

Blocks of pine wood (4 inches×3 inches×3 inches), provided as test specimens, were predried at 60° C. overnight. The blocks were then placed in an impregnator consisting essentially of a pressure cylinder connected through respective valves to a nitrogen source, a supply of tannic acid in solution (5 percent weight per volume in ethanol), and a vacuum pump. The tannic acid was obtained from the Sigma Chemical Company, St. Louis, Mo. A cap on the cylinder was unscrewed to permit placing the pine blocks in the cylinder, and then tightly screwed back into sealing relation with the cylinder. The cylinder was then evacuated to 3 mm Hg by opening the valve connected to the vacuum pump and activating the pump. This valve was then closed, a second valve was then opened to permit the tannic acid solution to enter the cylinder in an amount sufficient to cover the blocks, and the second valve was then closed. Finally, the third valve was opened to allow nitrogen under pressure (100 psi) to enter the cell. Impregnation was carried out for two hours.

At the end of the impregnation period, the nitrogen valve was then closed, and the tannic acid valve slowly opened to allow unabsorbed tannic acid to flow out of the cylinder into an overflow container. The cylinder was then filled with a 40 percent weight per volume aqueous solution of ferric chloride. Impregnation was carried out under a pressure of 40 psi for four hours. As with the tannic acid, unabsorbed ferric chloride was drained from the cylinder. The blocks were then removed from the cylinder and dried at 60° C. overnight. Excess tannic acid and ferric chloride were washed from the blocks by placing them under running water for two hours. The washing was done primarily so that individuals handling the wood would not have to touch unabsorbed chemicals.

Five blocks each of untreated wood, wood treated with 5 percent tannic acid, and wood treated with 5 percent tannic acid and 40 percent ferric chloride according to the Test Example were placed in an embayment in Ft. Lauderdale, Fla. The water is known to be heavily infested with wood boring teredine mollusks. After nine months the wood was removed and X-rayed for the presence of marine borers. The data are as follows:

| Treatment | No. of blocks infested by marine borers |
|---|---|
| None | 5 |
| 5% tannic acid | 3 |
| 5% tannic acid + 40% ferric chloride | 0 |

VARIATIONS AND MODIFICATIONS

As to permissible variations in the practice of the invention the metal selected need only be one that will form a complex with the tannic acid and the wood and that will go into solution in the form of a salt. A quick and easy test of whether a given metal has formed the desired complex is visual observation of the wood's turning dark brown or black, indicating that complexing has occurred. A longer but also effective test of complexing is to determine whether wood impregnated with tannic acid and a particular salt will give longer borer portection than the same wood treated only with tannic acid, like the test run in the previously described Test Example. Next to iron, manganese and copper are most preferred. Other metals should be chosen from the standpoint of easy solubility, low cost and, if possible, low toxicity. Instead of the most preferred chloride, the salt can also be a sulfate of the metal chosen. Less preferred but useable are bromide and iodide salts. Concentration of the metal in salt form need not be high because normally very little is needed to complex fully with the wood and tannic acid. Beyond that point additional metal will perform no function. Generally, concentration of the salt can range from 1 to 50 percent weight per volume and, more preferably, should range from 1 to 10 percent. Impregnation time and pressure can be varied to vary the amount of impregnation, but as just noted, there is normally a relatively low breakpoint beyond which additional salt impregnation has no effect. In any case impregnation time can range from 1 to 12 hours and impregnation pressure from 20 to 100 psi. How long one predries the wood, which one does to make impregnation easier, depends on how wet the wood is initially.

As to permissible variations in the step of impregnation with tannic acid, the parameters of tannic acid concentration, impregnation time, and impregnation pressure can be varied to vary the amount of impregnation and consequently the length of time the wood remains resistant. Effective impregnation can be achieved with tannic acid concentration of from 5 to 50 percent weight per volume; the higher the concentration, generally the longer the resistance of the treated wood. To achieve the same degree of protection, a lower concentration of tannic acid is needed than would otherwise be required without the added step of salt impregnation. To prolong the protection, one should use the same concentration of tannic acid that he would have used without that added step. Likewise, increasing pressure or time of impregnation extends impregnation effectiveness. The minimum impregnation time is one hour, and the minimum pressure is 50 psi. The thicker the wood to be impregnated, generally the higher the pressure desirable. In commercial use, excess tannic acid and salt are not washed off after impregnation. Finally, any organic solvent for tannic acid, such as acetone, carbon tetrachloride, or methanol, can be used in place of ethanol as the solvent.

Further information about the basic process of impregnation with tannic acid alone and examples of that process may be found in the previously referred to copending U.S. patent application Ser. No. 619,565, the contents of which are hereby incorporated by reference herein.

Other embodiments are within the scope of the claims.

What is claimed is:

1. An improved process for protecting wood which comprises the steps of impregnating wood with a solution of tannic acid in a concentration of 5–50% weight per volume for protecting from wood degrading organisms and placing said wood, for use, in seawater, and of impregnating said wood with a 1–50% weight per volume solution of a metal salt, of which the metal is capable of complexing with both the impregnated tannic acid and the wood.

2. The process of claim 1 wherein said metal is selected from the group consisting of iron, manganese, and copper.

3. The process of claim 2 wherein said metal is iron.

4. The process of claim 2 wherein said salt is selected from the group consisting of chloride and sulfate salts.

5. The process of claim 3 wherein said salt is ferric chloride.

6. The process of claim 2 wherein said salt solution is impregnated under pressure.

7. The process of claim 1 wherein said salt concentration is from 1 to 10 percent weight per volume.

8. The process of claim 7 wherein said salt concentration is 1 percent weight per volume.

9. The process of claim 2 wherein said salt solution is an aqueous solution.

10. The process of claim 1 wherein said wood is pine.

11. The process of claim 6 wherein said pressure is from 20 to 100 psi.

12. The process of claim 11 wherein said impregnating with said salt solution is carried on from 1 to 12 hours.

13. An improved process for protecting wood from wood degrading organisms which comprises impregnating wood with a 5–50% weight per volume solution of tannic acid, and impregnating said wood, after said impregnating with said solution of tannic acid, with an aqueous 1–50% weight per volume solution of ferric chloride under pressure of from 20 to 100 psi for from 1 to 12 hours.

14. An article of commerce produced in accordance with the process of claim 1.

15. An article of commerce comprising wood impregnated with a 5–50% weight per volume solution of tannic acid and with a solution of a metal in the form of a salt, said metal being capable of complexing with both the impregnated tannic acid and the wood.

16. The article of claim 15 wherein said metal is selected from the group consisting of iron, manganese, and copper.

* * * * *